US006237443B1

(12) United States Patent
Liedschreiber

(10) Patent No.: US 6,237,443 B1
(45) Date of Patent: May 29, 2001

(54) DEVICE FOR MANUALLY SHARPENING CUTTING TOOLS

(76) Inventor: Karl Liedschreiber, Kirchstr. 15, D-83112 Umrathshausen (DE)

( * ) Notice: Subject to any disclaimer, the term of this patent is extended or adjusted under 35 U.S.C. 154(b) by 0 days.

(21) Appl. No.: 09/366,209

(22) Filed: Aug. 4, 1999

(30) Foreign Application Priority Data

Sep. 10, 1998 (DE) ..... 198 41 494

(51) Int. Cl.[7] ..... B24D 15/00

(52) U.S. Cl. ..... 76/88

(58) Field of Search ..... 76/82, 82.2, 87, 76/84; 451/549, 555, 558; D8/91–94

(56) References Cited

U.S. PATENT DOCUMENTS 1,573,875 * 2/1926 Shaw ..... 451/555 X

FOREIGN PATENT DOCUMENTS

24292 * 3/1919 (DK) ..... 76/87

* cited by examiner

*Primary Examiner*—Douglas D. Watts
(74) *Attorney, Agent, or Firm*—Jones, Tullar & Cooper, P.C.

(57) ABSTRACT

A device for manually sharpening cutting tools, especially hand-held cutting tools, comprising a shaft-shaped supporting body, being at least at one end provided with an edge indentation associated with a sharpening tool made of hard metal a and a central tongue projecting into the edge indentation for forming lateral entering grooves terminating at the sharpening tool for a tool to be sharpened. A long tool life of the sharpening tool made of hard metal may be achieved in that the sharpening tool is formed as a circular sharpening plate being rotatable round its axis and being arranged in the area of the inner end of the associated edge indentation with an axis vertically to the edge indentation and the tongue projecting over the plate. The sharpening plate is arranged displaceably in the longitudinal direction of the edge indentation.

17 Claims, 2 Drawing Sheets

DEVICE FOR MANUALLY SHARPENING CUTTING TOOLS

FIELD OF THE INVENTION

The present invention relates to a device for manually sharpening cutting tools, especially hand-held cutting tools, comprising a shaft-shaped supporting body being at least at one end provided with an edge indentation associated with a sharpening tool made of hard metal, a central tongue projecting into the edge indentation for forming lateral entering grooves for a tool to be sharpened terminating at the sharpening tool.

BACKGROUND OF THE INVENTION

A device of thus kind is known from DE-U 2 97 04 759. With this known arrangement, the sharpening tool is formed as a rectangular bar. The bar may be turned. However, the effective working length is limited to a comparatively small central area, since the bar must be held reliably. Therefore, the available effective working length is comparatively quickly worn out. Therewith, a comparatively short total tool life and therewith a comparatively bad material exploitation and altogether a bad economic efficiency results.

SUMMARY OF THE INVENTION

Starting from this, the problem to be solved by the present invention is to improve a device of the kind mentioned above with simple and cheap means in such a way that a long tool life is achieved.

The solution to this problem is achieved according to the present invention in a surprisingly simple way in that the sharpening tool is formed as a circular plate being rotatable about its axis and being arranged in the area of the inner end of the associated edge indentation with its axis being vertical to the plane of the edge indentation and the tongue projecting over the plate.

The sharpening plate used here may be used for sharpening over its total periphery. The effective working length therefor corresponds to the total length of the periphery and therewith to the total length of the available edge. This ensures a long tool life and therewith good material exploitation and good economic efficiency. Therefore, with the measures according to the present invention the disadvantages of the known arrangement are completely eliminated.

The tongue may advantageously be provided with at least one further entering groove for a tool to be sharpened. This tongue-sided entering groove is intersected by the sharpening plate under a comparatively obtuse angle and is therefore advantageously useful especially for sharpening cutting tools with a comparatively big intersection angle as is the case with e.g. scissors or other cutting dies. In contrast to this, the lateral entering grooves of the sharpening plate are intersected under a comparatively arcute angle and accordingly, are more suitable for sharpening cutting tools with a comparatively arcute intersection angle as e.g. with knife blades etc. Altogether, the mentioned measure therefore results in a sharpening head with universal usability.

A further advantageous measure may be that the plate forming the sharpening tool is arranged adjustably in the longitudinal direction of the edge indentation. Hereby, it is possible to change the angle under which the sharpening plate intersects the lateral flanks of the preferably inwardly widening edge indentation, thereby the geometrical dimensions may be adapted to the blade to be sharpened.

A further useful measure may be that the plate forming the sharpening tool is peripherally formed conically. This measure advantageously results in a sharp cutting whetting edge. This embodiment is advantageously possible because due to the big effective working length over the total periphery a possibility for turning of the plate may be omitted.

Further advantageous embodiments and useful modifications of the superior measures may be taken from the following description of examples by means of the drawings.

DESCRIPTION OF THE DRAWINGS

The drawing described in the following shows in

DESCRIPTION OF THE PREFERRED EMBODIMENT

Figure 1:
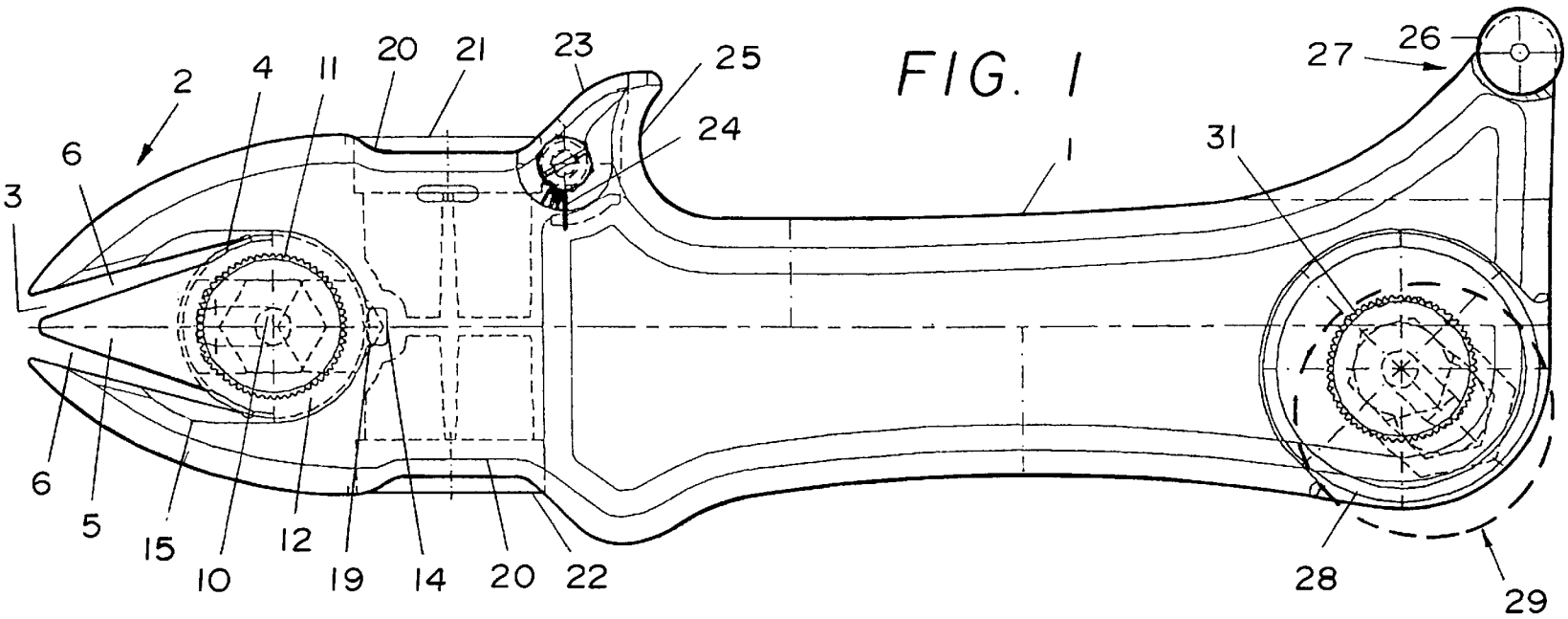
FIG. 1 is a top view onto a sharpening device according to the present invention.
Figure 3:
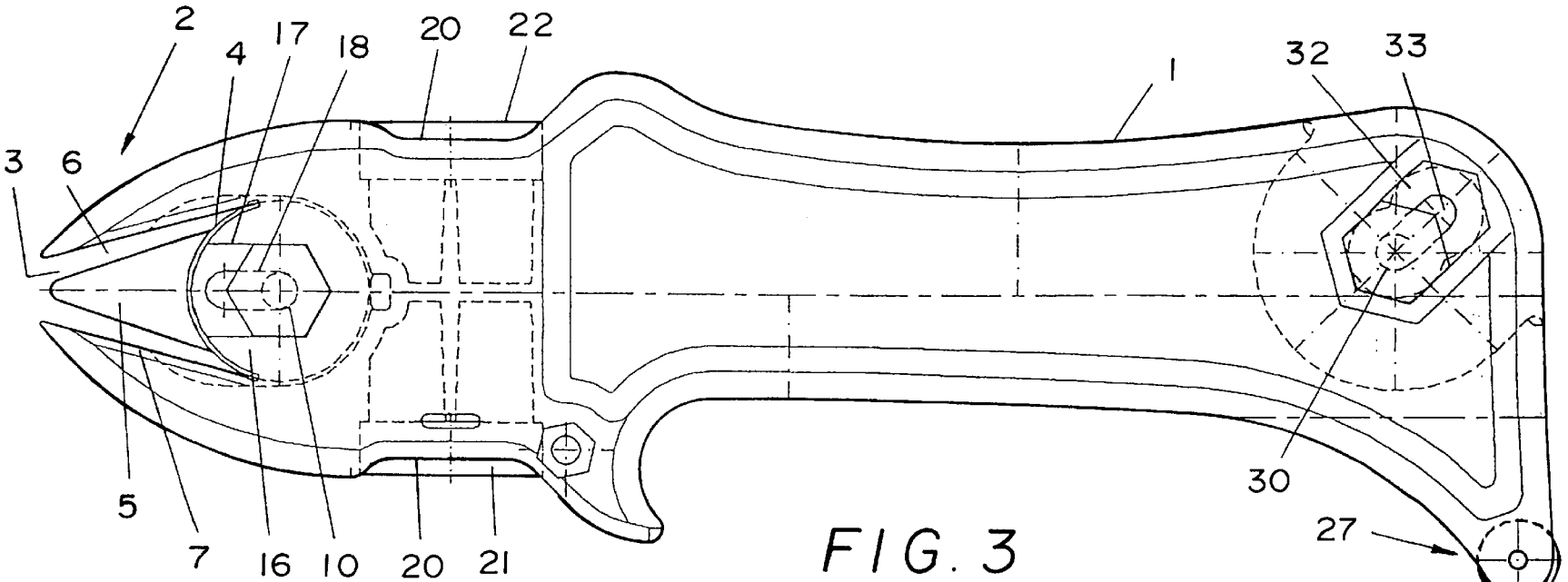
FIG. 3 is a bottom view of the sharpening device according to the invention.
Figure 2:
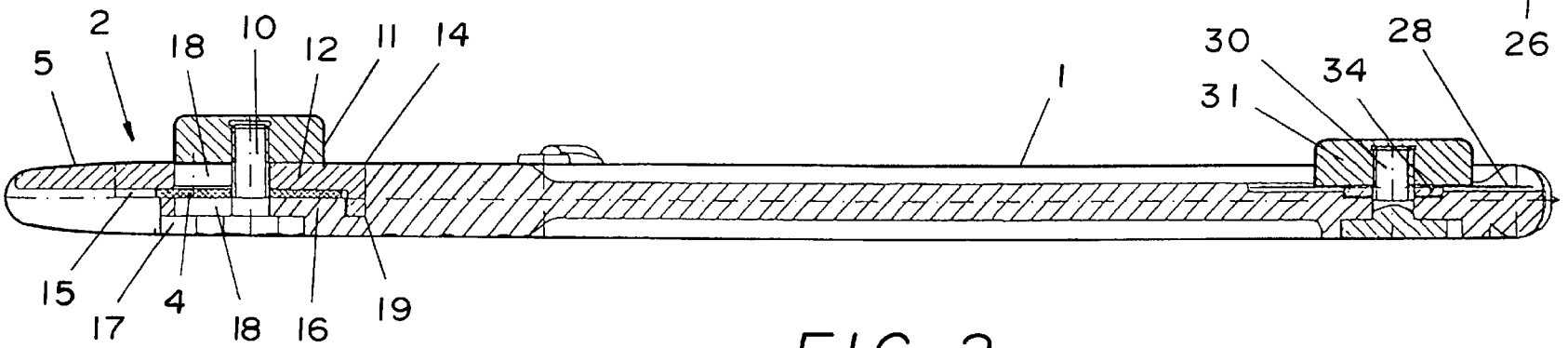
FIG. 2 is a longitudinal section of FIG. 1.

The sharpening device of the drawing consists of a a shaft-shaped supporting body 1 serving as a hand-grip which is provided at one end, shown in FIGS. 1 to 3 at the left side, with a sharpening head 2. Therefore, the shaft-shaped supporting body 1 is provided with an edge indentation 3 extending in the longitudinal direction of the supporting body 1 and widening inwardly, as is clearly shown in FIG. 1 and 3. In the area of the inner end of the edge indentation 3 a circular sharpening plate 4 is provided serving as a sharpening tool and being made of hard metal, the plate being arranged with its axis vertically to the plane of the edge indentation 3 and accordingly extending in parallel to the flat side of the supporting body 1.

A tongue 5 extending into the edge indentation 3 radially projects over the sharpening plate 4. The side flanks of the tongue 5 are arranged distantly of the side flanks of the edge indentation 3 widening inwardly for forming lateral entering grooves 6 for a cutting tool to be sharpened. The entering grooves 6 terminate inwardly at the periphery of the sharpening plate 4, the periphery of which intersects the entering grooves 6 under a comparatively arcute angle. The entering grooves 6 accordingly serve for sharpening cutting tools with a comparatively arcute intersection angle, like knife blades. The angle between the side flanks of the tongue 5 is bigger than the angle between the side flanks of the edge indentation 3 so that the entering grooves are widening outwardly simplifying the handling and allowing adaptation of the position of the tool to be sharpened to the desired intersection angle.

Figure 4:
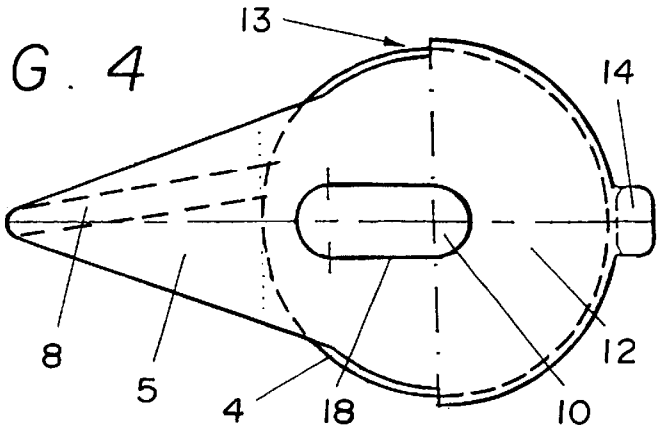
FIG. 4 is an enlarged top view of the subassembly comprising the sharpening plate and the tongue.

The tongue 5 may, as is shown in FIG. 4 in broken lines, be provided with a further entering groove 8 terminating in the area of the sharpening plate 4. This further entering groove 8 is usefully intersected by the sharpening plate 4 under a comparatively obtuse angle and may therefore be used for sharpening blades with a corresponding intersection angle, for example scissors. The arrangement of the entering groove 8 may be chosen in that the intersection angle between the entering groove 8 and the sharpening plate 4 corresponds to the usual intersection angle of scissor blades. With the illustrated embodiment, the entering groove 8 usefully extends obliquely to the central longitudinal axis of the device extending through the axis of the sharpening plate 4. The angle may thus be varied by displacement of the sharpening plate 4 in the direction of the central longitudinal axis. A transverse groove not shown in detail extending transversely to the inner end of the entering groove 8 may adjoin the inner end. It may effect a certain elasticity of the tongue 5. The transverse groove may extend about concentrically to the center of the sharpening plate 4.

Figure 5:
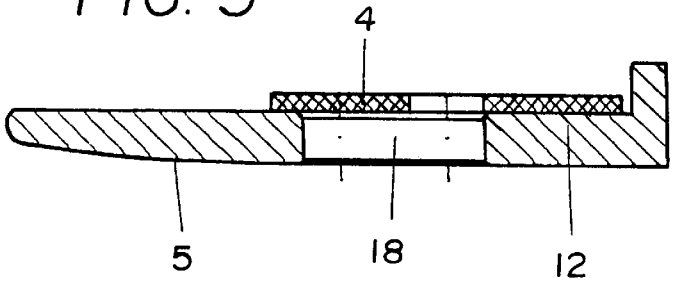
FIG. 5 is a longitudinal section of FIG. 4.

The tool to be sharpened is inserted into one of the entering grooves and is drawn with its blade along the upper edge of the periphery of the sharpening plate 4. Thereby, sharpening follows by a cutting whetting process. The side flanks of the edge indentation 3 are at least in the area of the bottom side of the supporting body 1 provided with a bezel 7, as may best be seen from FIG. 3, for enabling a slight tilting movement of the cutting tool to be sharpened in one of the lateral entering grooves. For achieving a sharp whetting edge, the sharpening plate 4 may be formed, as may best be seen from FIG. 5, conically narrowing downwardly. Thereby, an angle of inclination of 3° to 6° seems to be appropriate. This results in an associated clearance angle which intensifies the whetting process. In the illustrated embodiment, the sharpening plate is conically over its total width and, therefore, cannot be turned. It is also possible to provide the sharpening plate 4 at its edge with a V-shaped clearance grinding in cross-section so that a possibility of turning would be given.

The sharpening plate 4 is arranged rotatably round its center axis. Hereby, it is achieved that the total periphery of the sharpening plate 4 may be used as a sharpening edge. During a process of sharpening, the sharpening plate 4 is fixed by means of a fastening device further described below. As soon as the periphery of the sharpening plate 4 associated with an entering groove 6 and 8, resp., is worn out the fastening device is opened and the sharpening plate 4 is turned slightly. Afterwards, the fastening device is again tightened. This process may be repeated until the whole periphery of the sharpening plate 4 is worn out. This results in a long tool life of the sharpening plate 4.

The sharpening plate 4 is inserted into an associated impression 15 of the supporting body 1 being open towards the edge indentation 3. This impression is limited downwardly by supporting areas 16 carrying the sharpening plate 4. The impression 15 is formed as a groove extending in the longitudinal direction of the supporting body 1, as shown in FIG. 1, which turns into the edge indentation. The inner width of this groove corresponds to the diameter of the sharpening plate 4. The length of said groove is bigger. Within the groove, the sharpening plate 4 may be displaced in the longitudinal direction of the supporting body. By displacement of the sharpening plate 4, the angle under which the sharpening plate 4 intersects the entering grooves 6 and 8, resp., may be changed. The more the sharpening plate is pushed further, the more the angle becomes obtuse. Therefore, an exact adaptation of the sharpening geometry to the geometry of the blade to be sharpened is possible hereby.

For forming the supporting areas mentioned above carrying the sharpening plate 4, a supporting web 16 bridging the lateral tines of the sharpening head 2 in the area of the inner end of the edge indentation 3, as may best be seen from FIGS. 2 and 3, and lateral supporting ridges 16*a* are provided extending from the web and being formed at the tines. The sharpening plate 4 is usually in the innermost position. In the position the sharpening plate 4 rests planely on the web 16. Only the front edge of the sharpening plate 4 is free, i.e. it is not supported, so that a whetting process is not hindered. The web 16 comprises accordingly a front edge extending in parallel to the periphery of the sharpening plate 4 , i.e. outwardly convex. If the sharpening plate 4 is slightly pushed forward for adjustment of the angle as mentioned above, it further projects over the web 16, being supported by the edge areas of the supporting ridges 16*a* adjoining the web 16.

The tongue 5 projects out of a disc-like plate 12 resting on the side of the sharpening plate 4 opposite to the supporting areas 16 as FIGS. 1, 2 and 4, 5 show. The plate 12 has in the areas adjoining the tongue 5 a diameter slightly smaller than the diameter of the sharpening plate 4 so that the sharpening plate projects over the plate 12 in these areas associated with the lateral entering grooves 6, as may clearly be seen from FIG. 4. The half of the periphery of the plate 12 turned away from the tongue 5 has a diameter exceeding the diamter of the sharpening plate 4, thereby protecting the associated peripheral area of the sharpening plate 4. Accordingly, in the transition area between the different diameter areas is a step 13, clearly shown in FIG. 4.

The plate 12 including the tongue 5 is fastened together with the sharpening plate 4 by means of the already mentioned fastening device at the supporting body 1. The fastening device comprises in the illustrated embodiment a cap screw 10 reaching through the web 16 of the supporting body carrying the sharpening plate 4, the sharpening plate 4 and the plate 12 resting on the sharpening plate and comprising the tongue 5. The cap screw 10 rests with its head adjacent to the web 16 , and therefore to the supporting body 1, and, on the other hand, cooperates with a knurled nut 11 which rests on the plate 12.

The head of the cap screw 10 is so far sunk in the supporting body 1, as may further be seen from FIG. 2, that there is no edge projecting out of the even bottom side of the supporting body 1. Therefore, it is ensured that the supporting body 1 may be laid evenly with its even bottom side on a table, only the sharpening head 2 projecting so far that a tool to be sharpened may be inserted into one of the entering grooves 6 and 8, resp., and may be whetted at the sharpening plate 4.

For enabling the desired ajustability of the sharpening plate 4 in the longitudinal direction of the supporting body 1 the recesses of the stationary parts associated with the cap screw 10 extending through a bore of the sharpening plate 4 are formed as elongated holes and grooves, resp. The web 16 is provided with a longitudinal groove 17 receiving the head of the cap screw 10 arranged in a sunken manner and with an elongated hole 18 penetrated by the shaft of the cap screw 10. If the tongue 5 and accordingly the plate 12 carrying the tongue 5 are stationary, as in the illustrated embodiment, the plate 12 also comprises a corresponding elongated hole 18. The way of displacement of the sharpening plate 4 is limited by the length of the grooves and elongated holes, resp.

With the illustrated embodiment, the tongue 5 is arranged stationary as mentioned above, i.e. non-rotatable and non-displaceable contrary to the sharpening plate 4. For ensuring this, the plate 12 is provided at the periphery opposite to the tongue 5 with a bar 14 reaching beyond the sharpening plate 4 meshing without clearance with an associated holding recess 19 in the supporting body. It would also be possible to provide longitudinal displaceability of the tongue 5. In this case, the holding recess 19 would have to be formed as a longitudinal groove. By longitudinal displacement of the tongue 5, the inner width of the lateral entering grooves 6 may be amended. Besides, it is ensured that the angle between the sharpening plate 4 and the side flanks of the tongue 5 is the same for each position of the sharpening plate 4.

In the area of the portions of the side flanks of the supporting body 1 adjoining the sharpening head 2, lateral receiving recesses 20 are provided in which further sharpening devices, for example a bar-shaped whetting steel 21 and a burnishing stone 22 resp., etc. may be arranged. These sharpening tools are associated with stopping faces at the side opposite to the sharpening head 2. With the illustrated embodiment, the stopping face associated with the whetting steel 21 is formed as a pivotable stop 23 fixed by means of an attachment screw, its angle of inclination being adjustable with regard to the associated surface of the whetting steel 21 as is indicated by an angle scale 24. The stop 23 may be pivoted away from a web 25 which acts as a an abutment for the finger and protection against sliding off. The opposite burnishing stone 22 may be associated with a stationary stopping face.

In the area of the end of the supporting body 1 opposite to the sharpening head 2 further sharpening devices may be provided. With the illustrated embodiment, the end of the supporting body 1 is provided with two cutting devices, namely with a glass cutter 27 comprising a rotatable scratching roll 26 and a cutting device 29 for wallpapers etc. comprising a rotatable knife 28. The rotatable knife 28 is moveable from the inactive position, shown in FIG. 1 by continuous lines, sunk in the supporting body 1 to the active position moved out of the supporting body 1 and shown in FIG. 1 by broken lines, and vice versa. A fastening device is provided for fixing comprising a cap screw 30 reaching through it and a knurled nut 31 cooperating with it, as may best be seen from FIG. 2. The head of the cap screw 30 is inserted into an associated groove 32 from which it does not project out. The shaft of the cap screw 10 reaches through an associated elongated hole 33. The rotating knife 28 is, as may further be seen from FIG. 2, received on a plate 34 provided with a suitable collar. The knurled nut rests at the plate in such a way that a continuous nut results therefrom being associated with the knife 28 so that the knife is rotatable.

What is claimed is:

1. A device for manually sharpening cutting tools, especially handheld cutting tools, comprising; a shaft-shaped supporting body being at least at one end provided with an edge indentation associated with a sharpening tool; a sharpening tool made of hard metal; and a central tongue projecting into said edge indentation for forming lateral entering grooves for a tool to be sharpened terminating at the sharpening tool, whereby the sharpening tool is formed as a circular sharpening plate being rotatable about its axis and being arranged in the area of the inner end of the associated edge indentation with its axis being vertical to the plane of said edge indentation and the tongue projecting over the plate, and whereby the sharpening plate is arranged displaceably in the longitudinal direction of the edge indentation.

2. A device according to claim 1, whereby the tongue is provided with at least one further entering groove for a tool to be sharpened.

3. A device according to claim 1, whereby the edge indentation is inwardly widened and the tongue is tapered towards the free end.

4. A device according to claim 3, whereby the side flanks of the edge indentation are inclined towards each other under a smaller angle than the side flanks of the tongue.

5. A device according to claim 1, whereby the side flanks of the edge indentation are provided with a bezel.

6. A device according to claim 1, whereby the sharpening plate is inserted into a groove in the supporting body turning into the edge indentation.

7. A device according to claim 1, whereby the sharpening plate is fixable by means of a fastening device reaching through an elongated hole in the supporting body.

8. A device according to claim 7, whereby the fastening device comprises a cap screw reaching through a bore of the sharpening plate, the head of said cap screw meshing with a groove in the supporting body and on the shaft of which reaching through an elongated hole in the supporting body a knurled nut may be screwed.

9. A device according to claim 1, whereby the tongue projecting into the edge indentation is arranged stationary.

10. A device according to claim 9, whereby the tongue projects out of a plate which may be laid onto the sharpening plate, said plate comprising an elongated hole being associated with the fastening device, and being fixable with the sharpening plate by means of the fastening device.

11. A device according to claim 10, whereby the plate comprises at the edge area opposite to the tongue a bar reaching beyond the sharpening plate and meshing with a holding recess in the supporting body.

12. A device according to claim 10, whereby the sharpening plate radially projects over the plate in the peripheral areas adjoining the tongue and that the peripheral half of the plate opposite to the tongue comprises a diameter exceeding the diameter of the sharpening plate.

13. A device according to claim 1, whereby at least one peripheral edge of the sharpening plate is formed as a cutting edge having a clearance angle.

14. A device according to claim 1, whereby the supporting body comprises in the area of the end being opposite to the edge indentation associated with the sharpening plate at least one cutting device, preferably a rotatable knife which may be moved in and out and/or a rotatable scratching roll.

15. A device for mutually sharpening cutting tools, especially hand-held cutting tools, comprising: a shaft-shaped supporting body being at least at one end provided with an edge indentation associated with a sharpening tool; a sharpening tool made of hard metal; and a central tongue projecting into said edge indentation for forming lateral entering grooves for a tool to be sharpened terminating at the sharpening tool, whereby the sharpening tool is formed as a circular sharpening plate being rotatable about its axis and being arranged in the area of the inner end of the associated edge indentation with its axis being vertical to the plane of said edge indentation and the tongue projecting over the plate, whereby the edge indentation is inwardly widened and the tongue is tapered towards the free end, and whereby the side flanks of the edge indentation are inclined towards each other under a smaller angle than the side flanks of the tongue.

16. A device for manually sharpening cutting tools, especially hand-held cutting tools, comprising: a shaft-shaped supporting body being at least at one end provided with an edge indentation associated with a sharpening tool; a sharpening tool made of hard metal; and a central tongue projecting into said edge indentation for forming lateral entering grooves for a tool to be sharpened terminating at the sharpening tool, whereby the sharpening tool is formed as a circular sharpening plate being rotatable about its axis and being arranged in the area of the inner end of the associated edge indentation with its axis being vertical to the plane of said edge indentation and the tongue projecting over the plate, and whereby the side flanks of the edge indentation are provided with a bezel.

17. A device for manually sharpening cutting tools, especially hand-held cutting tools, comprising: a shaft-shaped supporting body being at least at one end provided with an edge indentation associated with a sharpening tool; a sharpening tool made of hard metal; and a central tongue projecting into said edge indentation for forming lateral entering grooves for a tool to be sharpened terminating at the sharpening tool, whereby the sharpening tool is formed as a circular sharpening plate being rotatable about its axis and being arranged in the area of the inner end of the associated edge indentation with its axis being vertical to the plane of said edge indentation and the tongue projecting over the plate, whereby the tongue projecting into the edge indentation is arranged stationary, and whereby the tongue projects out of a plate which may be laid onto the sharpening plate, said plate comprising an elongated hole being associated with the fastening device, and being fixable with the sharpening plate by means of the fastening device.

* * * * *